US009328941B2

(12) United States Patent
Jensen

(10) Patent No.: US 9,328,941 B2
(45) Date of Patent: May 3, 2016

(54) SERVICE WATER HEATING UNIT HAVING HEAT EXCHANGERS AND CIRCULATION PUMPS

(75) Inventor: Olav Jensen, Viborg (DK)

(73) Assignee: Grundfos Management a/s, Bjerringbro (DK)

( * ) Notice: Subject to any disclaimer, the term of this patent is extended or adjusted under 35 U.S.C. 154(b) by 1179 days.

(21) Appl. No.: 13/194,103

(22) Filed: Jul. 29, 2011

(65) Prior Publication Data

US 2012/0024518 A1 Feb. 2, 2012

(30) Foreign Application Priority Data

Jul. 30, 2010 (EP) ..... 10007977

(51) Int. Cl.

| | |
|---|---|
| ***F28F 27/00*** | (2006.01) |
| ***F16K 49/00*** | (2006.01) |
| ***F24H 9/14*** | (2006.01) |
| ***F24D 3/10*** | (2006.01) |

(52) U.S. Cl.

CPC *F24H 9/14* (2013.01); *F24D 3/105* (2013.01); *F24H 9/142* (2013.01); *F24H 9/148* (2013.01)

(58) Field of Classification Search

CPC ... F28D 21/0005; F28D 21/0007; F24H 1/12; F24H 1/14; F24H 1/16; F24H 1/18; F24H 1/208

USPC ..... 137/340; 165/200, 96, 101, 102, 103

See application file for complete search history.

(56) References Cited

U.S. PATENT DOCUMENTS

| | | | | | |
|---|---|---|---|---|---|
| 3,011,681 | A | * | 12/1961 | Kromer | 137/12.5 |
| 3,048,375 | A | * | 8/1962 | Walker | 165/96 |
| 3,666,003 | A | * | 5/1972 | Clark et al. | 165/299 |
| 4,046,189 | A | * | 9/1977 | Clark, Jr. | 165/299 |
| 4,127,164 | A | * | 11/1978 | Erwin | 165/45 |
| 4,129,179 | A | * | 12/1978 | Molitor | 165/101 |
| 4,216,879 | A | * | 8/1980 | McMillin | 137/340 |
| 4,237,969 | A | * | 12/1980 | Andre et al. | 165/103 |
| 4,348,135 | A | * | 9/1982 | St. Clair | 405/36 |
| 4,429,830 | A | * | 2/1984 | Forster et al. | 237/19 |

(Continued)

FOREIGN PATENT DOCUMENTS

| | | |
|---|---|---|
| DE | 10304679 A1 | 8/2004 |
| EP | 0548536 A1 | 6/1993 |

(Continued)

OTHER PUBLICATIONS

EP Search Report issued Dec. 23, 2010 in EP Application No. 10007977.1.

(Continued)

*Primary Examiner* — Ljiljana Ciric

(74) *Attorney, Agent, or Firm* — Panitch Schwarze Belisario & Nadel LLP

(57) ABSTRACT

A service water heating unit (2) provided for use in a heating installation includes at least one heat exchanger (6), having a first flow path (10) in which a heating medium flows and a second flow path (12) in which service water to be heated flows, and a first circulation pump (46) which pumps the heating medium. The first circulation pump (46) is connected to the first flow path (10) of the heat exchanger (6) and mounted onto the heat exchanger (6). The service water heating unit (2) can also include a second circulation pump (76) mounted to on the heat exchanger (6), that pumps the heated service water.

20 Claims, 15 Drawing Sheets

(56) References Cited

U.S. PATENT DOCUMENTS

Figure 1:
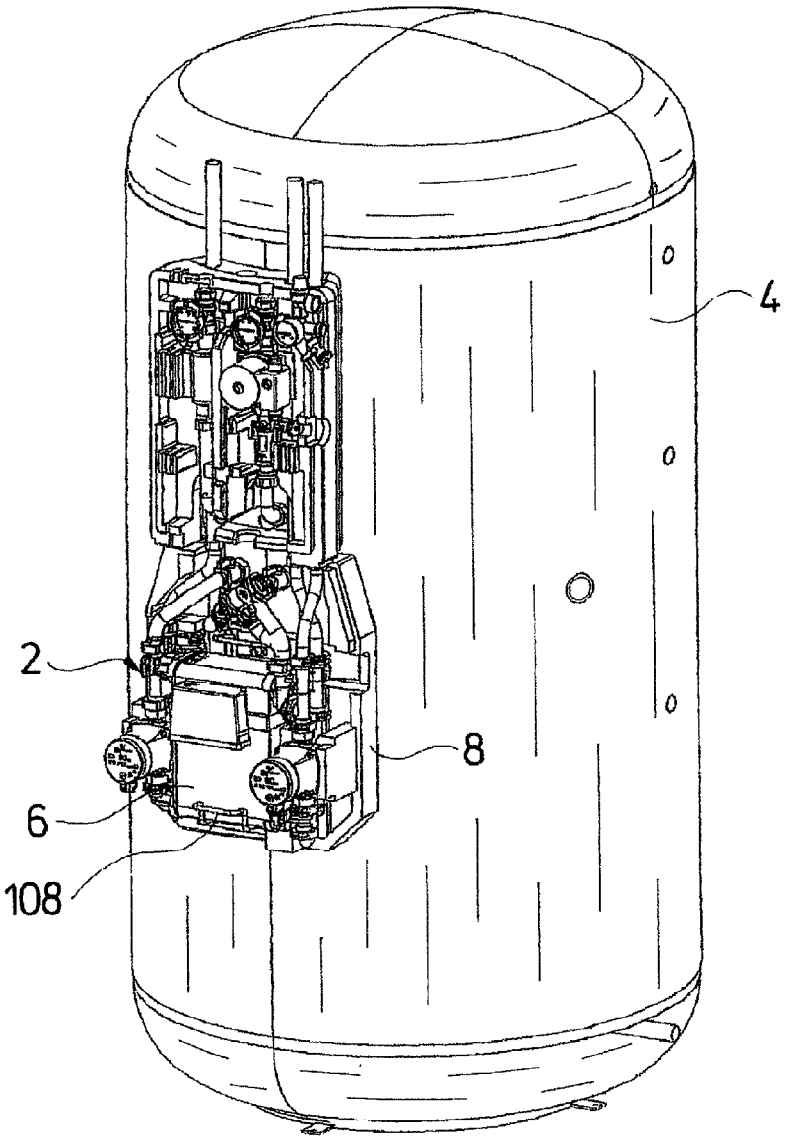

| | | | | |
|---|---|---|---|---|
| 4,754,779 | A * | 7/1988 | Juhasz | 137/340 |
| 4,784,213 | A * | 11/1988 | Eager et al. | 165/101 |
| 4,881,380 | A * | 11/1989 | Mrugala et al. | 222/146.1 |
| 5,115,491 | A * | 5/1992 | Perlman et al. | 137/340 |
| 5,320,161 | A * | 6/1994 | Iiams | 137/340 |
| 5,403,564 | A * | 4/1995 | Katschnig et al. | 422/307 |
| 5,417,274 | A * | 5/1995 | Verkaart | 165/103 |
| 5,863,580 | A * | 1/1999 | Reznik | 426/237 |
| 5,881,763 | A * | 3/1999 | Angelos | 137/340 |
| 5,983,922 | A * | 11/1999 | Laing et al. | 137/340 |
| 6,026,844 | A * | 2/2000 | Laing et al. | 137/340 |
| 6,032,869 | A * | 3/2000 | Ito et al. | 165/103 |
| 6,173,681 | B1 * | 1/2001 | Pope | 122/451.1 |
| 6,196,246 | B1 * | 3/2001 | Folsom | 137/340 |
| 6,294,135 | B1 * | 9/2001 | Joo et al. | 422/173 |
| 6,367,703 | B1 * | 4/2002 | Morosas | 237/55 |
| 6,415,858 | B1 * | 7/2002 | Getchel et al. | 165/101 |
| 6,749,014 | B2 * | 6/2004 | Ferraro | 165/47 |
| 6,802,368 | B2 * | 10/2004 | Getchel et al. | 165/101 |
| 6,827,091 | B2 * | 12/2004 | Harrison | 137/340 |
| 6,835,307 | B2 * | 12/2004 | Talbert et al. | 165/200 |
| 6,935,361 | B2 * | 8/2005 | Rocheleau | 137/340 |
| 7,566,430 | B2 * | 7/2009 | Katschnig et al. | 422/307 |
| 7,766,077 | B2 * | 8/2010 | Masters et al. | 165/200 |
| 7,866,380 | B2 * | 1/2011 | Masters et al. | 165/200 |
| 7,959,814 | B2 * | 6/2011 | Masters et al. | 165/200 |
| 8,495,893 | B2 * | 7/2013 | Alajimi | 222/146.1 |
| 8,678,706 | B2 * | 3/2014 | Luciano, Jr. | 137/340 |
| 9,004,018 | B2 * | 4/2015 | Boros et al. | 122/18.31 |
| 2002/0060065 | A1 * | 5/2002 | Ferraro | 165/156 |
| 2004/0206485 | A1 * | 10/2004 | Ferraro | 165/156 |
| 2007/0158048 | A1 * | 7/2007 | Ferraro | 165/47 |
| 2009/0101309 | A1 * | 4/2009 | Strelow | 165/103 |
| 2009/0178717 | A1 | 7/2009 | Mirchildon | |

FOREIGN PATENT DOCUMENTS

| | | | |
|---|---|---|---|
| GB | 2433101 | A | 6/2007 |
| JP | 2005-089568 | A | 4/2005 |

OTHER PUBLICATIONS

Office Action issued Jul. 22, 2014 in China Application No. 201110223782.1.
English translation of Office Action.
Search Report issued in China Application No. 201110223782.1.

* cited by examiner

SERVICE WATER HEATING UNIT HAVING HEAT EXCHANGERS AND CIRCULATION PUMPS

The invention relates to a service water heating unit, which is provided for use in a heating installation, having the features disclosed in the preamble of claim 1.

Service water normally also has to be heated in heating installations. For this purpose, it is known to provide either water stores, in which the service water is heated, or else to use heat exchangers, in which the service water is heated, in a flow heater style, by a heating medium in a heating circuit.

In conventional heating installations a system for the heating of service water is therefore integrated in the heating installation or heating boiler.

In newer heating installations a plurality of heat sources, for example a heating boiler and a solar installation are often used. In such heating installations constructed of a number of components, it is difficult to integrate a system for the heating of service water in a specific system part. The object of the invention is therefore to provide a service water heating unit which can easily be integrated in a heating system and which integrates in a single unit all essential components necessary for the heating of service water.

This object is achieved by a service water heating unit having the features disclosed in claim 1. Preferred embodiments will emerge from the dependent claims, the description below and the drawings.

The service water heating unit according to the invention is a module in which the components essential for the heating of service water are integrated. In particular, this is a heat exchanger which comprises a first flow path for a heating medium and a second flow path for the service water to be heated. The heating medium may preferably be water of a heating circuit fed from a heating boiler or, for example, from a heat accumulator. The service water heating unit further comprises a circulating pump for the heating medium, which circulating pump is connected to the first flow path of the heat exchanger and is fastened on the heat exchanger. This circulating pump feeds the heating medium to the heat exchanger, it being possible, depending on the heat demand for heating the service water, to adjust or control the feed of heating medium to the heat exchanger by switching the circulating pump on and off and, if necessary, by controlling the speed of the circulating pump.

Furthermore, sensors, which are still required, and a control unit for controlling the heating of the service water are preferably integrated in the service water heating unit. If necessary, valves and/or further hydraulic components which are still required can also be integrated in the service water heating unit, such that this constitutes a module which can be supplied in a pre-assembled state and can be integrated in a heating system. The service water heating unit preferably comprises, outwardly, merely the necessary line connections for connection to external pipelines, in particular namely an inlet for the heating medium, an outlet for the heating medium, an inlet for the service water to be heated and an outlet for the service water to be heated. The flow inside the service water heating unit is guided by pipelines and/or preferably integrated connection component parts or connectors, in each of which one or more flow paths or ducts are formed and which connect to the heat exchanger. These connection parts and connectors can preferably be produced as component parts made of plastics material by injection moulding.

In accordance with the invention a second circulating pump is further fastened, or can be fastened to the heat exchanger in the service water heating unit and serves as a circulation pump for heated service water. Such a service water heating unit preferably comprises an additional line connection for connection to a circulation line or a plurality of circulation lines of a building to be supplied with service water. Such a circulation line normally branches off in the building at the removal point for the service water farthest from the service water heating unit so as to enable a circulation of the service water in the entire line system, such that this is always filled with heated service water and waiting times when removing service water at a removal point are thus avoided.

In accordance with the invention it is now provided for the circulation pump necessary for this circulation of the service water not to be installed separately in a heating system, but to be integrated in the service water heating unit so that it can be a component part of a pre-assembled unit. The second circulating pump is also fastened, or can be fastened on the heat exchanger, which thus constitutes a bearing element of the service water heating unit.

In accordance with the invention the second circulating pump can be integrated rigidly in the service water heating unit as a circulation pump. Alternatively, it is also possible to construct the service water heating unit in a modular manner, in such a way that a second circulating pump which serves as a circulation pump can optionally be fastened on the heat exchanger. For this purpose corresponding connection points and fastening mounts are arranged on the heat exchanger or the on connectors connected to the heat exchanger, in such a way that a second circulating pump can optionally be fixed on the heat exchanger if such a circulation pump is desired. The circulation pump, together with the associated components such as sensors and further connection parts, can thus form a circulation module which can optionally be integrated in the service water heating unit, corresponding interfaces and fastening elements for connecting this circulation module and components thereof already being provided in the service water heating unit.

The second circulating pump is preferably fluidly connected to the heat exchanger in such a way that the circulation line opens via the circulating pump into the second flow path of the heat exchanger, such that circulated service water is again guided into the heat exchanger, where it can be heated. Owing to the integration of the second circulating pump, i.e. a circulation pump in the service water heating unit, the installation process of the heating installation is further simplified since no separate system parts, in particular no separate pump for the circulation of service water, have to be mounted in the heating installation or in the building, but can easily be mounted, as a component part of the pre-assembled service water heating unit comprising the other components necessary for the heating of service water, in the form of a module. The control for the circulation, i.e. the circulation pump and any sensors which may be necessary is preferably likewise integrated in the service water heating unit. The integration of control, pumps and any necessary sensors in the service water heating unit further affords the advantage that the number of electrical connection points to be produced during assembly of the service water heating unit is minimised since merely one mains power supply preferably has to be produced.

The first circulating pump is preferably connected via a first connection to the first flow path of the heat exchanger point, and via a second connection point to a line connection for the heating medium. The intake connection of the circulating pump is thus preferably connected to the line connection for the heating medium, and the pressure connection is preferably connected to the first flow path of the heat exchanger. An external pipeline is connected to the line connection, for example for connection to a heating boiler or a water store. The line connection is preferably formed as a standardised interface, in particular as a plug connection or with a thread so as to produce a simple connection to external pipelines.

The second circulating pump is preferably connected via a first connection point to a line connection for a circulation line, and via a second connection point to a line connection for a service water line or to the second flow path of the heat exchanger. In other words, the external pipelines, in particular a circulation line, only have to be connected to the line connections of the service water heating unit. The circulation pump and other necessary piping for the circulation of service water are already integrated in the service water heating unit. These line connections are also preferably formed, in a standardised manner, as plug or screw couplings in order to produce a simple connection to external lines. The second circulating pump, as described above, is particularly preferably connected directly to the second flow path of the heat exchanger. The pressure connection of the second circulating pump expediently opens into the second flow path of the heat exchanger in order to guide the circulated service water into the heat exchanger, where it is heated again.

The heat exchanger is particularly preferably a plate heat exchanger. Such plate heat exchangers can be produced in a cost-effective manner, provide large heat transfer areas, internally, between the first and second flow paths, and are also inherently stable, such that they may form the central bearing component part of the service water heating unit, as described above. All other components, such as connectors, connection parts, circulating pumps, etc. can thus be fastened on the heat exchanger and therefore it is possible to dispense with an additional bearing structure. The plate heat exchanger is formed, in a known manner, as a stack of mutually spaced plates, wherein the first and second flow paths generally extend alternately between the plates so that the first and second flow paths are each separated from one another by a plate, via which the heat transfer takes place.

The circulating pumps are preferably arranged on the heat exchanger in such a way that the axes of rotation of the first and/or second circulating pumps extend parallel to the plates of the heat exchanger. This enables a particularly compact construction of the service water heating unit, since the pumps are oriented parallel to the plates of the heat exchanger.

More preferably, the first and second circulating pumps are arranged on two mutually opposed sides of the heat exchanger. In other words, the heat exchanger lies between the two circulating pumps and thus forms a central bearing component part. Owing to this arrangement, the connection between the two circulating pumps and the heat exchanger in the form of a bearing element is simplified, and a particularly compact construction of the entire service water heating unit can be achieved.

The mutually opposed sides on which the circulating pumps are fastened are preferably formed by the outer plates of the plate heat exchanger. The connection openings of the two flow paths inside the heat exchanger are preferably formed in these plates, such that the circulating pumps can be connected to these openings so as to guide the flow from the sides and can simultaneously be fastened to the heat exchanger on these sides.

In accordance with a further preferred embodiment, a connector is mounted on the heat exchanger at the inlet of the second flow path, i.e. of the flow path for the service water, and comprises a line connection for a service water line and is connected to a connection point of the second circulating pump. The connector thus comprises, internally, a T-shaped flow duct from which a first branch extends towards the line connection, a second branch extends towards the circulating pump and a third branch extends towards the connection opening or towards the inlet of the second flow path of the heat exchanger. In other words, the flow paths from the line connection and from the second circulating pump are guided together in the connector and open together into the inlet of the heat exchanger.

The line connection on this connector is preferably provided for connection to a cold water line. In other words, the service water to be heated is fed to the service water heating unit via this line connection. Owing to the discharge of the flow duct from the second circulating pump, both the circulated service water from the second circulating pump and the fed cold water are thus guided into the second flow path of the heat exchanger in order to be heated there.

More preferably, a temperature and/or flow sensor is arranged in a flow path in the connector. These sensors can be used to control or regulate the service water heating unit. In particular, they can be used to establish whether service water is requested in the system, i.e. whether a service water flow from the service water feed, that is to say a cold water line, is provided. Furthermore, they can detect the temperatures in order to accordingly adjust and/or control the feed of heating medium, in particular via the first circulating pump, and to keep the service water at a desired temperature.

A temperature sensor is particularly preferably used in the aforementioned connector in order to detect a service water request or the service water demand. For this purpose, as described, the connector in a flow duct preferably comprises a first duct portion or branch to the line connection and a second duct portion or branch to the second circulating pump, these meeting at a junction. A third duct portion or branch branches off from this junction and leads to the connection opening or inlet of the heat exchanger. The temperature and/or flow sensor is preferably arranged in the first branch, i.e. the branch leading towards the line connection, at a distance from the junction. This arrangement makes it possible to reliably detect the service water request on the basis of the temperature in this duct portion. This is particularly advantageous in conjunction with service water circulation since, with use of the service water circulation, the service water request, i.e. a drawing of service water at a removal point, cannot be reliably detected owing to a flow in the lines.

It cannot be distinguished as to whether the flow is caused by the circulation or the opening of a water tap. If a temperature sensor or a combined temperature/flow rate sensor which detects the temperature is arranged in the duct portion to the line connection at a distance from the junction at which the circulation line from the second circulating pump discharges, fluctuations in temperature can be detected which are reliably indicative of a service water request. In the circulation mode, if no service water is drawn then the water located in this duct portion will also be heated owing to its proximity to the duct portion which leads to the second circulating pump and through which the circulated service water flows. If service water is now drawn, fed cold water flows through the duct portion to the connection line and the temperature falls, it is thus being possible for the drawing of service water to be detected reliably and for the first circulating pump for feeding heating medium to the heat exchanger to be started up by a control unit.

In accordance with a further preferred embodiment, a fastening element is mounted on the heat exchanger, to which fastening element at least one pipeline connected to the second circulating pump is fastened. Such a pipeline can connect the second circulating pump to a line connection for connecting a circulation line or a connector of the heat exchanger. All line connections of the service water heating unit are preferably arranged on one side of the service water heating unit, more preferably in a single plane so that an interface is created, at which all external lines are connected to the service water heating unit.

In accordance with a specific embodiment of the invention, the second circulating pump is removable, wherein a connector for connection of the second circulating pump is provided and comprises a closable connection point for the circulating pump. This design makes it possible to form the service water heating unit according to the invention in a modular manner, such that the second circulating pump comprising any line connections still necessary can optionally be used in the service water heating unit as a circulation module. At least one connector is preferably fastened to the heat exchanger and remains on the heat exchanger irrespectively of whether or not the second circulating pump is mounted. Internally, the connector may comprise further flow paths, for example may produce the connection from a cold water line to the heat exchanger, as described. By closing the connection for the second circulating pump, for example by means of a closure stopper or another removable closure element, it is possible to fasten the second circulating pump to this connection point as a circulation module if necessary. Owing to this design, the required variety of parts is reduced since the same connector can be used, irrespectively of whether or not the circulation module is provided. Furthermore, it is easily possible to retrofit the second circulating pump as a circulation module in the service water heating unit as necessary.

In accordance with a further preferred embodiment, at least one sensor, in particular a temperature and/or flow rate sensor or volume flow rate sensor is provided and is connected to a data detection module which comprises an output interface designed for communication with an input interface of a control unit of at least of one of the circulating pumps. A plurality of the sensors, and in particular all the sensors provided in the service water heating unit, as well as external sensors if necessary, are preferably connected to this data detection module. For example, this may be achieved via electrical connection lines. The data detection module is used to communicate with the input interface of the control unit via a single output interface. The connection of the sensors to the control unit is thus simplified since they do not have to be connected directly to the control unit. The control unit preferably controls the service water heating unit, in particular by controlling at least one of the circulating pumps. In particular, the first circulating pump is thus controlled in such a way that it is switched on when there is a service water demand in order to feed heating medium to the heat exchanger to heat service water. Furthermore, the control unit may also include a controller or regulator, in particular a speed control for the first circulating pump in order to adjust the flow rate of heating medium, as necessary, based on the detected sensor signals.

The control unit or control device is preferably integrated, at least in part, as control electronics in one of the circulating pumps, in particular the first circulating pump. The connection and assembly of a separate control unit is thus omitted since this can be integrated directly in the electronics of the circulating pump unit. In particular, the arrangement of the data detection module is advantageous with this integration since the sensors do not all have to be connected individually to the control electronics of the pump unit and therefore an accordingly large number of connection points for individual sensors does not have to be provided on this pump unit.

The input interface and the output interface are preferably formed as wireless interfaces, in particular as radio interfaces, such that a line connection to the control unit for connection of the sensors can be completely omitted. A pump unit in which this control unit is integrated thus ideally also requires merely one electrical connection point to the mains power supply. The data detection module is preferably arranged as a connection and electronics unit in a housing which, in turn, is likewise fastened directly or indirectly on the heat exchanger in the form of a bearing component part of the service water heating unit.

A holding device is expediently mounted on the heat exchanger, which holding device fastens the service water heating unit and is preferably formed as a retaining clip. The holding device is used for fastening, for example in a heating installation or a heat accumulator. For example, it may be formed as a screw fastening or as a hook fastening, such that the holding device is designed, for example, in such a way that the service water heating unit can be suspended on a heat accumulator or on the wall from preassembled hooks. The holding device is preferably formed as a retaining clip in a bracket-shaped manner. This affords the advantage that the retaining clip can simultaneously form handle elements at which the service water heating unit can be gripped for assembly, thus facilitating handling.

Figure 2:
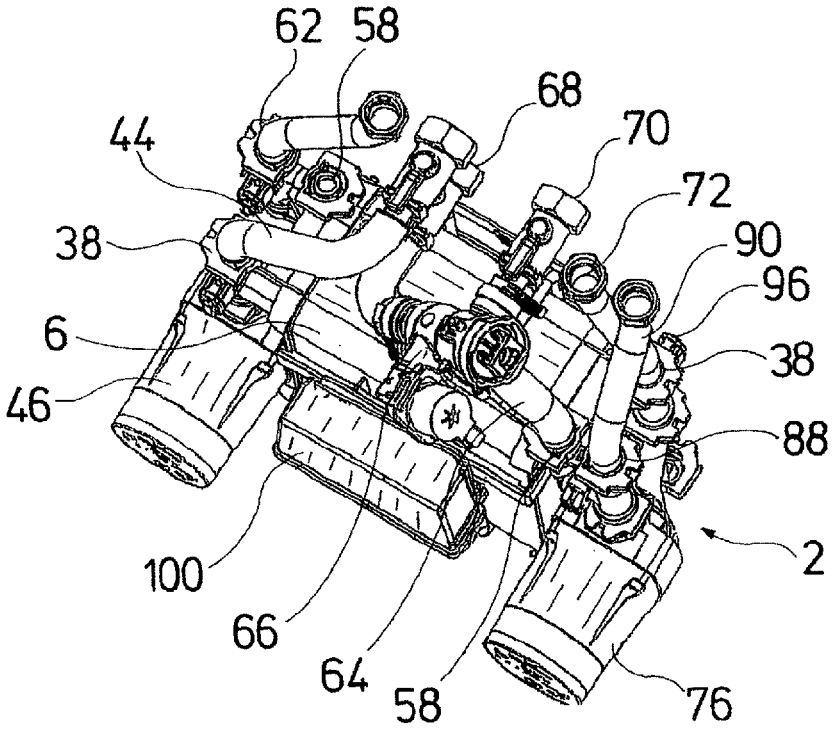

The service water heating unit will be described hereinafter by way of example with reference to the accompanying drawings, in which:

FIG. 1 shows an overall view of a service water heating unit arranged on a heat accumulator, FIG. 2 shows a perspective overall view of the service water heating unit according to FIG. 1.

Figure 3:
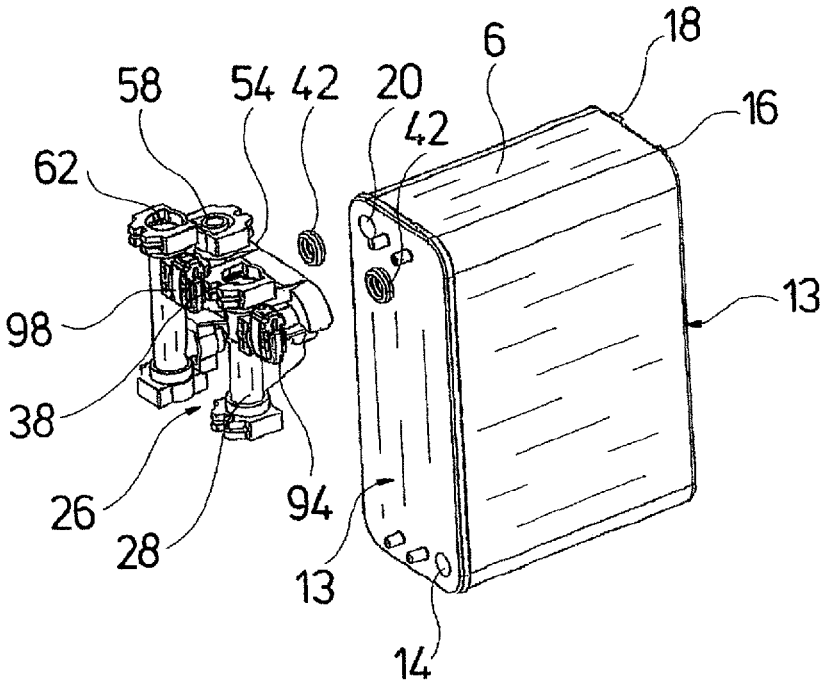
Figure 4:
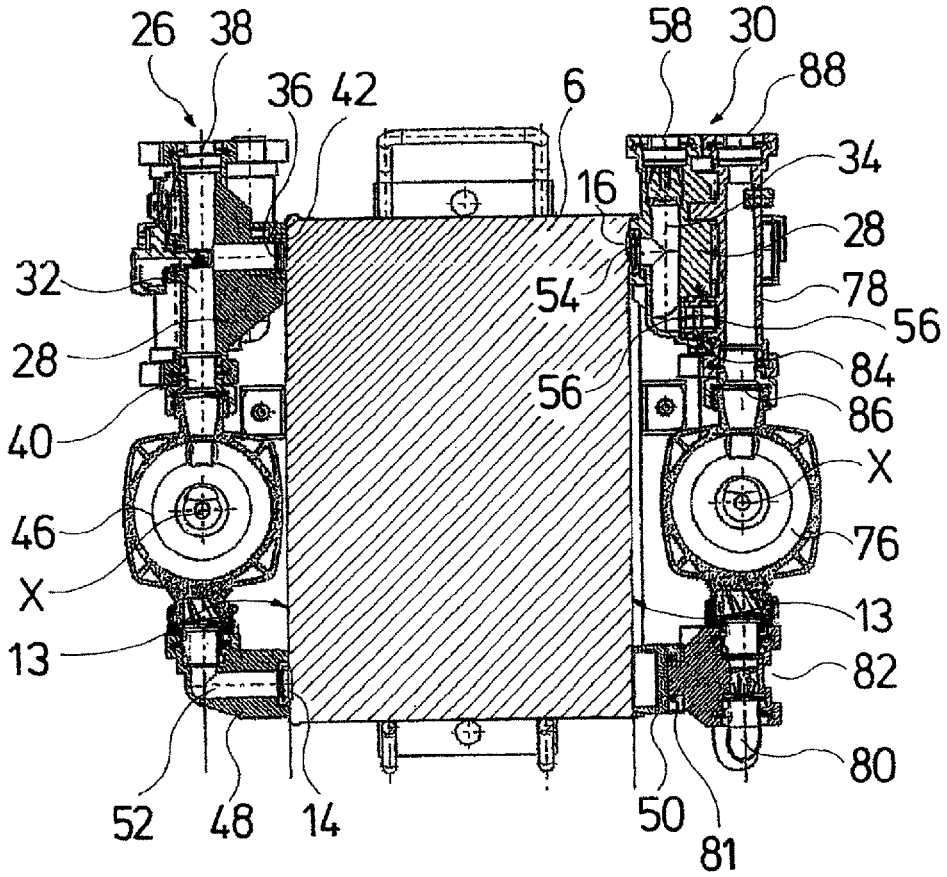
Figure 5:
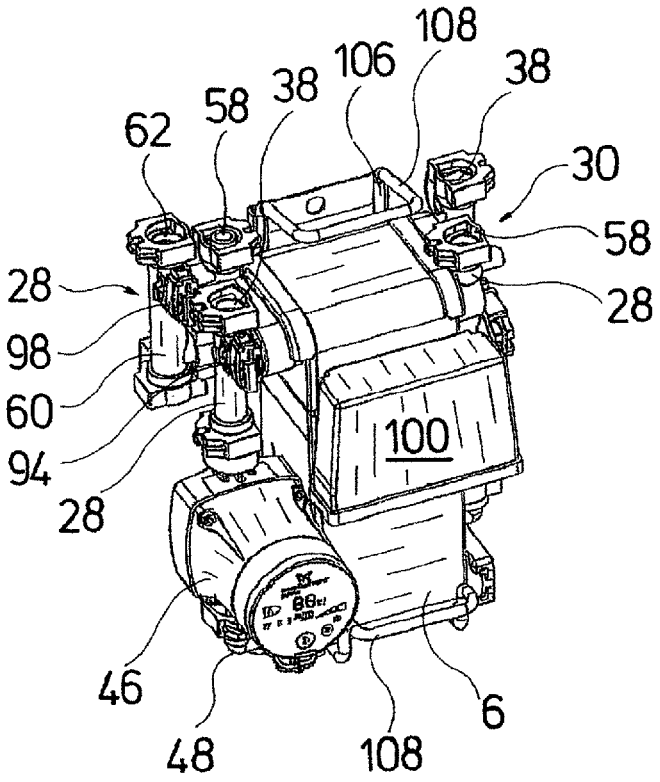
Figure 6:
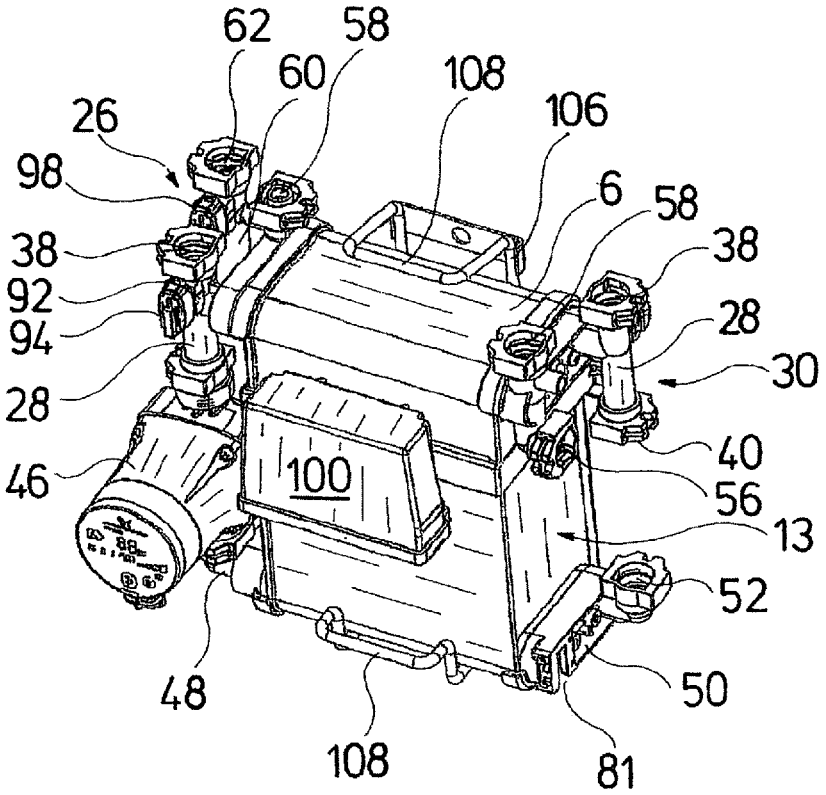
Figure 7:
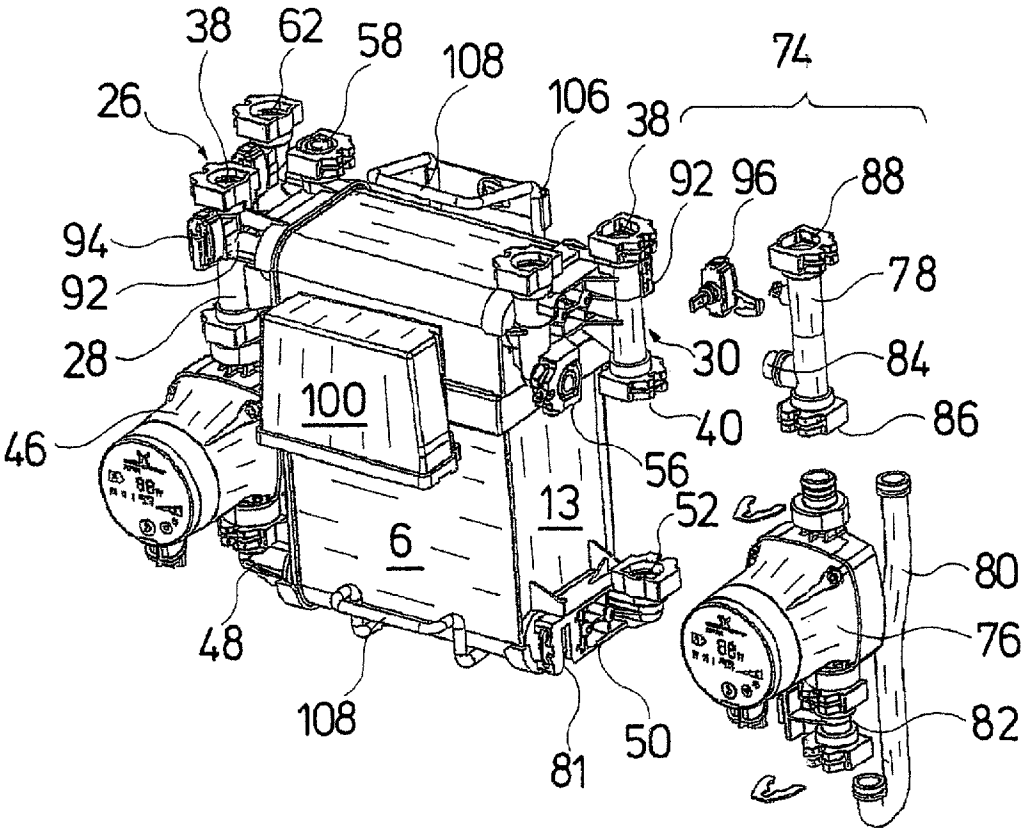
Figure 8:
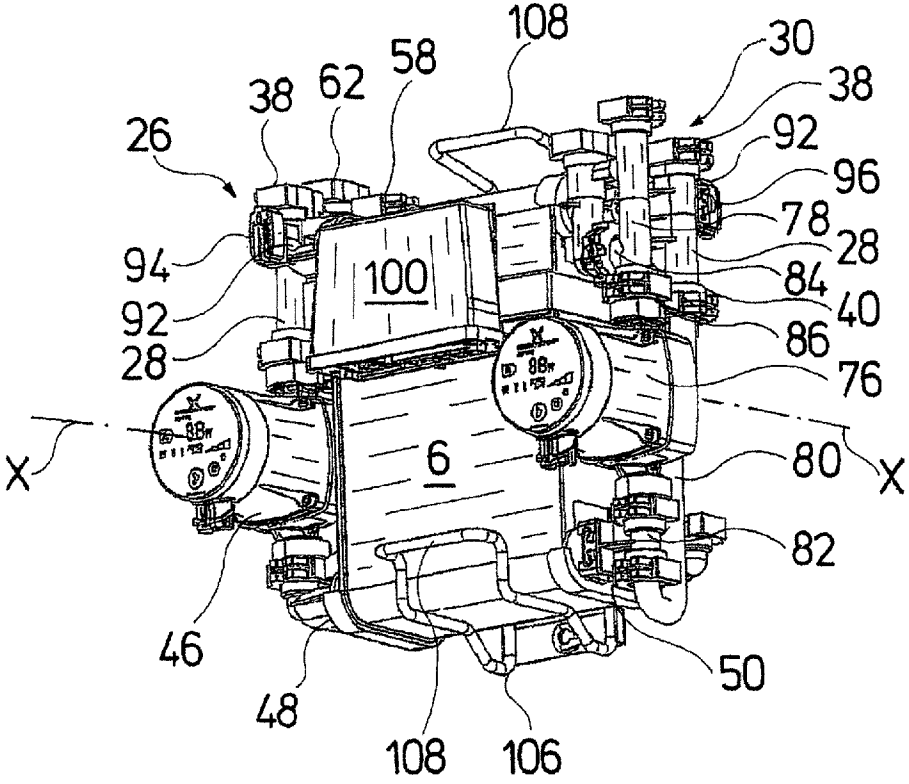
Figure 9:
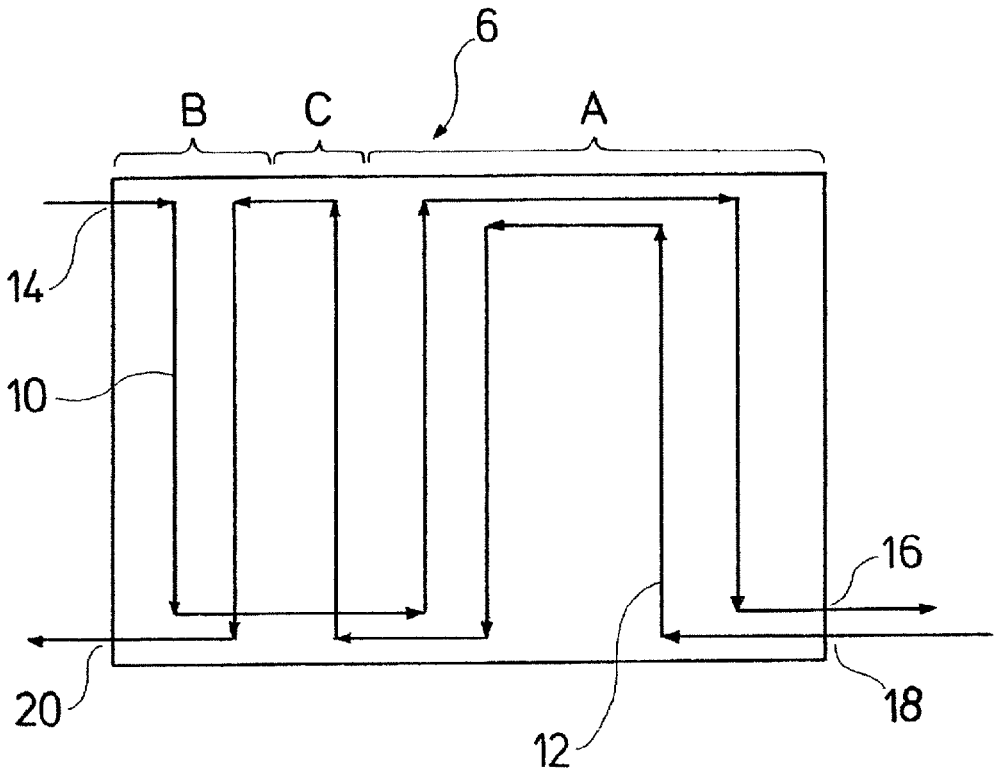
Figure 10:
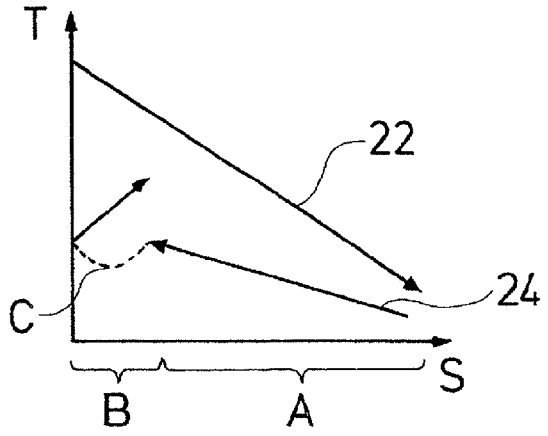
Figure 11:
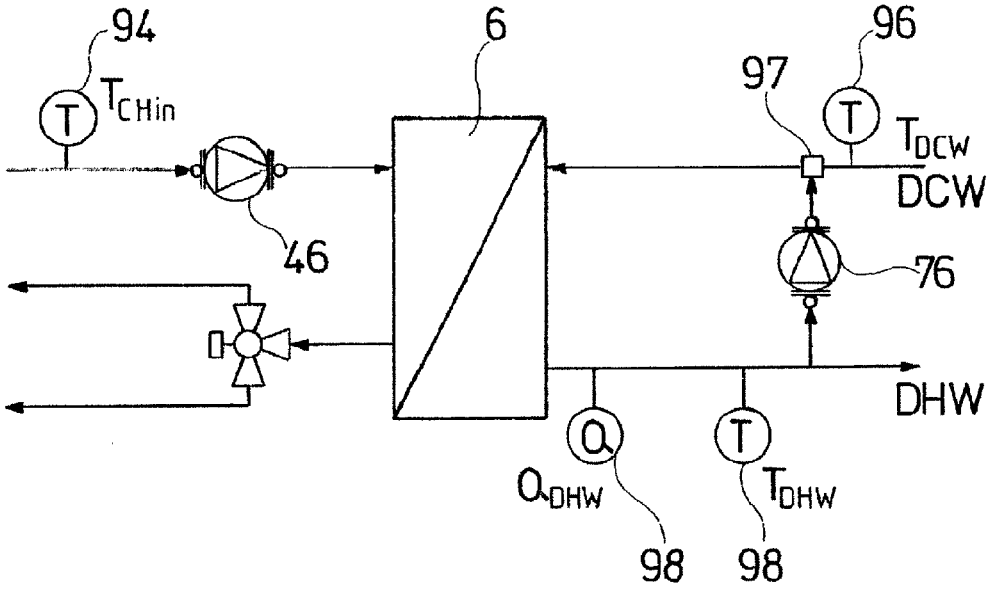
Figure 12:
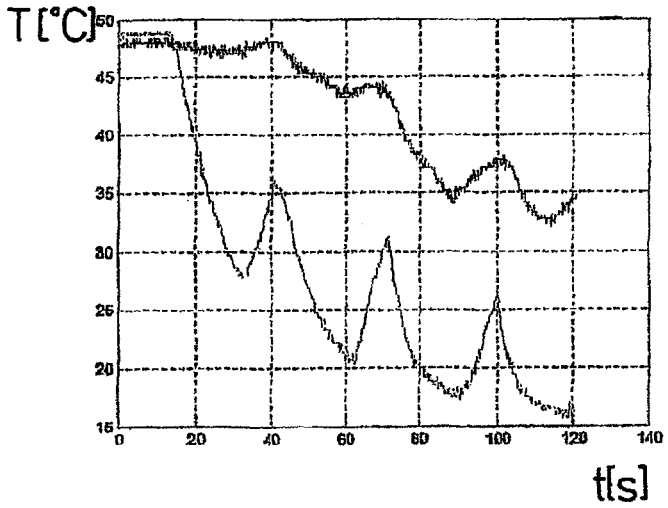
Figure 13:
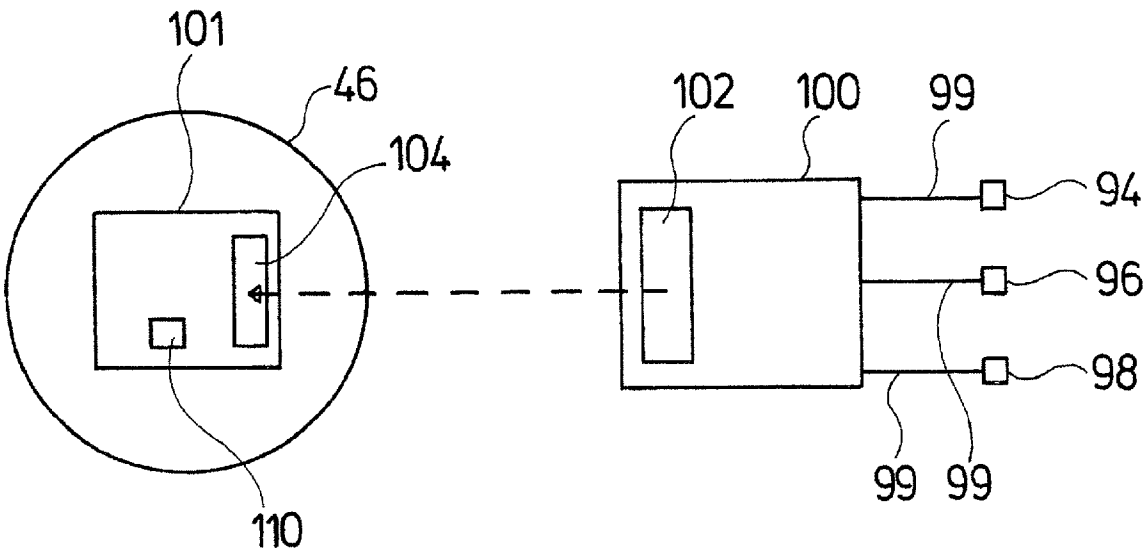
Figure 14:
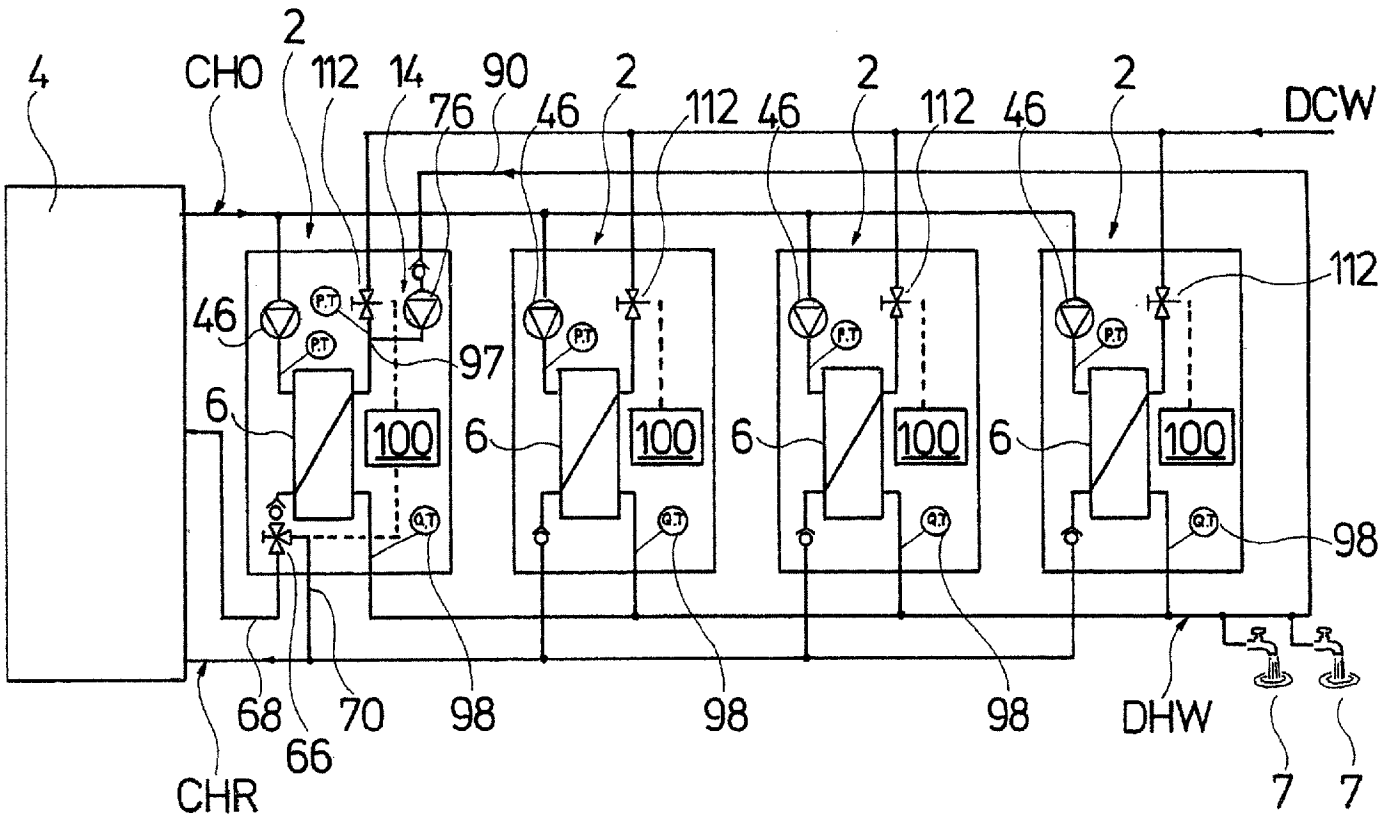
Figure 15:
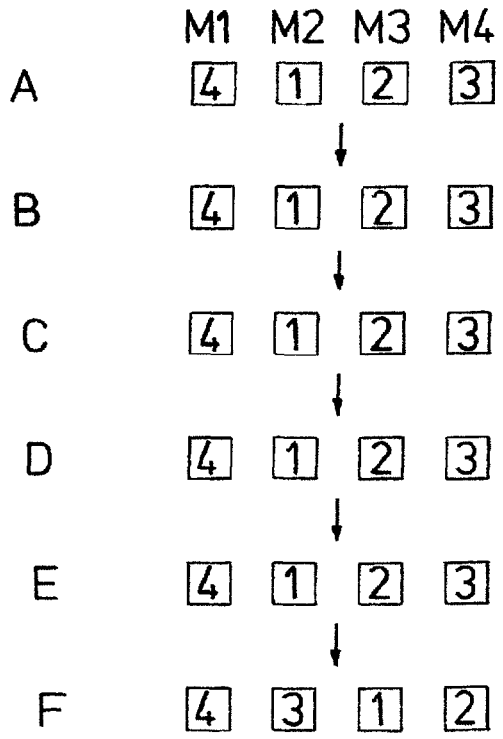
Figure 16:
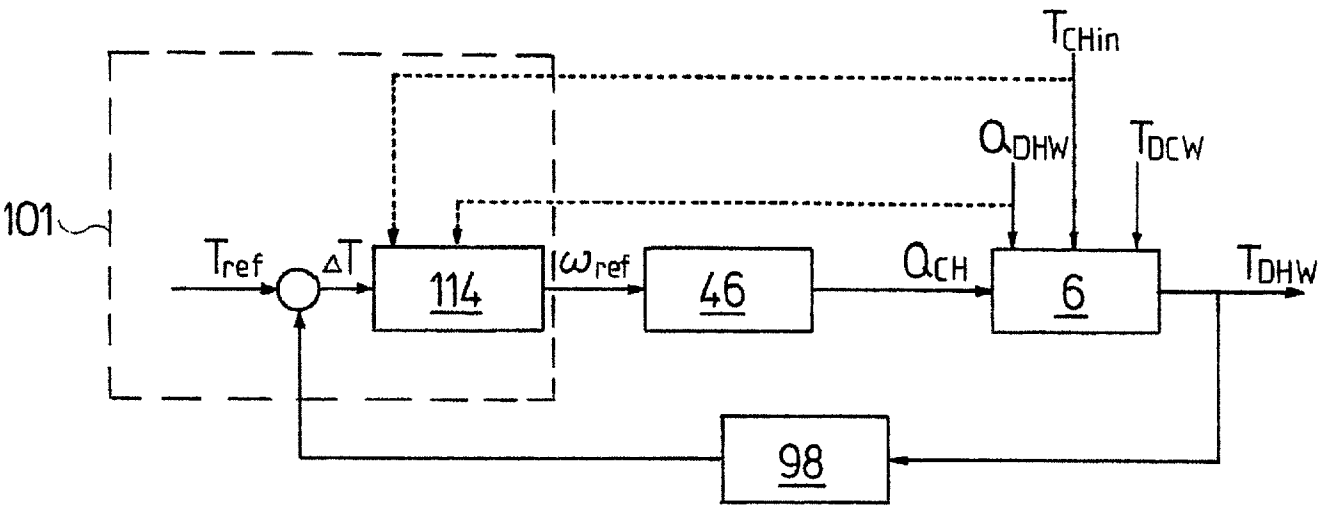

FIG. 3 shows a perspective view of the heat exchanger comprising a connector, FIG. 4 shows a sectional view of the service water heating unit according to FIG. 2, FIGS. 5 and 6 show a service water heating unit according FIGS. 1, 2 and 4 without a service water circulation module, FIG. 7 shows a perspective exploded view of the service water heating unit with a service water circulation module, FIG. 8 shows a perspective view of the service water heating unit with an assembled service water circulation module, FIG. 9 shows a schematic view of the flow paths inside the heat exchanger according to FIG. 3, FIG. 10 shows the temperature curve inside the heat exchanger over the flow path, FIG. 11 shows a hydraulic circuit diagram of a service water heating unit, FIG. 12 shows the temperature curve which is detected by a temperature sensor in the cold water inlet of the service water heating unit, FIG. 13 shows a schematic view of the data transfer from the sensors to a control device, FIG. 14 shows the arrangement of a plurality of service water heating units 2 in a cascade arrangement, FIG. 15 shows a schematic view of the control of the plurality of service water heating units according to FIG. 14, and FIG. 16 shows a schematic view of a control circuit for controlling the service water heating units.

The heat exchanger unit shown as an example is a service water heating unit 2 and is provided for use in a heating installation. In the example shown here (FIG. 1), the service water heating unit 2 is mounted on a heat accumulator 4, for example a water store, which stores heating water heated by a solar installation. The heat exchanger 6 of the service water heating unit 2 is supplied with heating medium from the heat accumulator 4 to heat service water. In FIG. 1 a housing surrounding the service water heating unit 2 is illustrated in the open position, i.e. the front cover is removed. In the other figures the service water heating unit 2 is illustrated without a surrounding housing.

The central component of the heat exchanger unit or service water heating unit 2 is a heat exchanger 6 in the form of a plate heat exchanger. Service water to be heated is heated via the heat exchanger 6 and discharged as heated service water, for example in order to supply tap points 7 of wash basins, showers, bathtubs, etc. in a house with hot service water. The heat exchanger is supplied with heating medium in order to heat the service water. Said heat exchanger is provided, internally, with two flow paths, as illustrated schematically in FIG. 9. A first flow path 10 is the flow path through which the heating medium is guided through the heat exchanger. The second flow path 12 is the flow path through which the service water is conveyed through the heat exchanger. Both flow paths are separated from one another in a manner known per se by plates, via which a heat transfer from the heating medium to the service water is possible.

The two outer plates 13 of the plate stack form two mutually opposed side faces of the heat exchanger 6. The fluid connection points 14 to 20 of the heat exchanger 6 are formed on these side faces and connectors are fastened there, as described below.

The heating medium passes through the inlet 14 into the heat exchanger 6 and exits again through the outlet 16. The service water to be heated enters into the heat exchanger 6 at the inlet 18 and exits again from the heat exchanger at the outlet 20. As is shown schematically in FIG. 9, the heat exchanger is divided into three portions A, B and C.

In the direction of flow of the service water through the second flow path 12, portion A forms a first portion in which the first flow path 10 and the second flow path 12 pass by one another in countercurrent. This means, the service water to be heated and the heating medium flow in opposite directions past the plates of the heat exchanger separating them. The effect of this is that the cold service water, which enters into the heat exchanger 6 at the inlet 18, is first heated by the heating medium, which has already been cooled, emergent at the outlet 16 and then passes in the direction of flow into the vicinity of increasingly hotter heating medium. The heat exchanger 6 comprises a second portion B in which the first flow path 10 and the second flow path 12 are no longer guided relative to one another in a countercurrent arrangement, but are guided in a co-current arrangement, i.e. the flows in the first flow path 10 and in the second flow path 12 run parallel in the same direction along the plates separating them or other heat-conducting separation elements separating them.

A reverse portion C is formed between the first portion A and the second portion B, in which reverse portion the relative reversal of the directions of flow in the flow paths to one another is carried out. In the example shown here the portions A, B and C of the heat exchanger are integrated in one heat exchanger. However, it is to be understood that the portions A and B could also be formed in separate heat exchangers and the direction reversal of the flows to one another in portion C could be achieved by a corresponding piping between the two heat exchangers.

Owing to the reversal to the co-current principle, the service water is prevented from being overheated since the heated service water emergent at the outlet 20 is not heated in the last portion of its flow path 12 directly by the hot heating medium entering at the inlet 14, but by heating medium which has already been cooled slightly. The maximum service water temperature to be achieved is thus limited. This can be seen in FIG. 10. In the diagram shown in FIG. 10 the temperature T of the heating medium is plotted as a curve 22 over the path S and the temperature T of the service water is plotted as a curve 24 over the path s. It can be seen that the outlet of the service water does not lie in the region of the highest temperature of the incoming heating medium, and in this regard a maximum temperature can be achieved which lies at the level of the temperature of the heating medium in the region of the outlet 20 of the service water from the heat exchanger.

The inlet 14 for the heating medium, the outlet 16 for the heating medium, the inlet 18 for the service water to be heated and the outlet 20 for the heated service water are formed on the plate heat exchanger 6 as fluid connection points, on which connectors are placed in turn and produce the connection to further component parts and pipelines. A first connector 26 is placed on the outlet 20 for the heated service water. This connector comprises a base element 28 which, in an identical configuration in the second connector 30 but merely rotated through 180°, is placed on the fluid connection points of the heat exchanger 6 forming the outlet 16 and the inlet 18. This affords the advantage that the same base element 28 can be used as a first connector and as a second connector and the number of different parts can be reduced.

Two separate flow ducts 32 and 34 are formed in the base element 28. The flow duct 32 is T-shaped and opens into three connection openings 36, 38 and 40 (see the sectional view in FIG. 4). When using the base element 28 as a first connector 26, the connection opening 36 is unused and closed by the wall of the heat exchanger 6, a seal 42 for sealing being arranged at the connection opening 38 between the base element 28 and the wall of the heat exchanger 6. The connection opening 38 forms the connection point for connecting to a feed line 44 which is connected to the heat accumulator 4 for supplying hot heating medium. At the connection opening 40 of the flow duct 32 arranged opposite, a first circulating pump 46 is arranged on the base element 28 during use in the first connector 26 and feeds the heating medium to the inlet 14 of the heat exchanger 6. For this purpose a third connector 48 is arranged on the inlet 14 and can be arranged, in an identical configuration but merely rotated through 180°, on the opposite side of the heat exchanger 6, as described below, as a fourth connector 50. This means, the third connector 48 and the fourth connector 50 are also formed at least of an identical base element.

A flow duct 52 is formed in the third connector 48 and connects the pressure connection of the circulating pump 46 to the inlet 14 of the heat exchanger.

As can be seen in the sectional view with reference to the second connector 30, the second flow duct 34 in the base element 28 is likewise T-shaped and comprises three connection openings 54, 56 and 58. The connection opening 58 of the second flow duct 34 is closed in the first connector 26, for example by an inserted stopper. The connection opening 54 is connected to the outlet 20 of the heat exchanger 6, a seal 42 likewise being arranged between the connector 26 and the heat exchanger 6. In the first connector 26 a connection part 60 is placed on the connection opening 56 of the second flow duct 34 and connects the connection opening 58 to the line connection 62 via a flow duct formed inside the connection part 60. The line connection 62 connects to a hot water line, through which the heated service water is removed.

The base element 28 is placed as a second connector 30 on the opposite end face of the plate heat exchanger 6, which forms the bearing structure of the service water heating unit. The outlet 16 for the heating medium and the inlet 18 for the cold service water are connected to the external installation by the second connector 30. With this arrangement of the base element 28 rotated through 180°, the connection opening 54 of the second flow duct 34 connects to the outlet 16 of the heat exchanger. This second flow duct 34 produces a connection to the line connection or connection opening 58, which forms the outlet of the cooled heating medium. A line can be connected to this connection opening 58 and guides the heating medium back into the heat accumulator 4. In the embodiment shown in FIG. 2, in which, as will be described below, a circulation of the service water is simultaneously provided, a line 64 is connected to the connection opening 58 and leads to a switching valve 66, which selectively produces a connection of the line 64 to the connection points 68 and 70. The connection points 68 and 70 connect to the heat accumulator 4, wherein these connection points can produce, for example, a connection to the inside of the heat accumulator 4 at different vertical positions so that, depending on the temperature of the heating medium emergent from the heat exchanger 6, said heating medium can be fed back into the heat accumulator 4 at different vertical positions by switching the switching valve 66 so as to maintain a layered arrangement of the heating medium in the heat accumulator. In particular, the switching function is advantageous if, as described below, a service water circulation module 74 is provided. The heating of the circulated service water requires a lower heat demand and therefore the heating medium flows back into the heat accumulator 4 at a higher temperature.

The flow path 32 inside the base element is connected at the second connector 30 to the inlet 18 by means of the connection opening 36. A cold water line 42 for feeding the cold service water is connected to the connection opening 38. The cold water enters the inlet 18 through this line and enters the heat exchanger.

The service water heating unit shown here can be used in two different embodiments, namely with a service water circulation module 74 or else without said service water circulation module 74. In FIGS. 1, 2, 4, 7 and 8 this service water circulation module 74 is arranged on the heat exchanger 6. FIGS. 5 and 6 show the arrangement without the service water circulation module 74. If the service water circulation module 74 is not provided, the fourth connector 50 is not necessary and the connection opening or line connection 40 of the base element 28 of the second connector 30 is closed by a stopper. In this case, the connection opening 56 of the flow duct 34 is closed by a stopper.

The service water circulation module 74 consists of a second circulating pump 76, which circulates the service water in the hot water line system of a building. A connection part 78 and a pipe 80 are provided for connection of the second circulating pump 76. In order to mount the pump 76 on the heat exchanger 6, a fourth connector 50, for this purpose, is arranged on the end of a side face and is identical to the third connector 48 or comprises an identical base element. However, when used as a fourth connector 50, the flow duct 52 is redundant. A seat 81 is formed in the base element of the third and fourth connectors, into which seat a connection element 82 is inserted which is connected to a pressure connection of the circulating pump 76. The connection element 82 comprises, internally, a flow duct and thus produces a connection to the pipe 80. The pipe 80 is connected at its end remote from the connection element 82 to the connection opening 40 of the flow duct 32 in the second connector 30, the connection opening 40 then not being closed by a stopper. The circulating pump 46 serving as a circulation pump can thus guide some of the heated service water back into the flow duct 32 of the second connector 30 and, through the connection opening 36 thereof, into the inlet 18 of the heat exchanger. This means, fed cold service water flowing through the connection opening 38 and service water fed back by the circulation pump 76 through the connection opening 40 flow together in the flow duct 32 of the second connector.

The connection part 48 is placed on the base element 28 of the second connector 30 in such a way that it engages in the connection opening 56 of the second flow duct 34 by a closed connecting piece 84 and thus closes the connection opening 56 in such a way that an additional stopper is no longer necessary to close said connection opening in the second connector 30. For the rest, the connection part 78 is tubular and connects two connection openings 86 and 88 located at opposite ends. The connecting piece 84 does not comprise a fluid connection to the connection between the line connections and connection openings 86 and 88. The connection opening 86 is connected to the intake connection of the second circulating pump 76 and the connection opening 88 forms a connection point to which a circulation line 90 is connected. By using the connection part 78 and a fourth connector 50, of which the base element is identical to the third connector 48, a second circulating pump 76, which constitutes a circulation pump, can likewise thus be fastened, with few additional parts, to the heat exchanger 6 serving as a bearing structure, and the circulation line can be directly connected, in fluid communication, to the second flow path 12 inside the heat exchanger via the circulating pump 46.

A sensor holder 92 is formed in the flow duct 32 in the base element 28 of the first and second connectors 26 and 30 and can be used to accommodate a sensor. When the base element 28 is used as a second connector 30, the sensor holder 92 is closed if no service water circulation module 74 is assembled. A temperature sensor 94 is placed in the sensor holder 92 in the first connector 26 and detects the temperature of the heating medium fed to the heat exchanger 6. With use of the service water circulation module 74, a temperature sensor 96 is also placed in the sensor holder 92 of the base element 28 of the second connector 30 and detects a service water demand, the specific functioning of this temperature sensor being described below. Furthermore, the connection part 60 also comprises a sensor holder in which a sensor 98 is placed. The sensor 98 is a combined temperature and flow sensor which detects the temperature and flow rate of the heated service water emergent from the outlet 20 from the heat exchanger 6 via the flow path 34 in the first connector 26. It is to be understood that the temperature sensors 94, 96 described above could also be used as combined temperature and flow rate sensors if necessary.

Owing to the sensor 98, the temperature of the emergent service water can be detected and, based on this temperature and on the temperature of the heating medium detected by the temperature sensor 94, the necessary volume flow rate of the heating medium can be determined and the first circulating pump 46 can be operated accordingly. The control or regulator for the circulating pump 46 necessary for this is preferably integrated into the circulating pump 46 as regulating or control electronics.

The sensors 94, 96 and 98 are connected via electrical lines 99 to a sensor box 100 which forms a data detection module. The sensor box 100 detects the data provided by the sensors 94, 96 and 98. As shown in FIG. 13, the sensor box 100 makes available the detected data of the control unit 101, which is integrated in this example into the control electronics of the pump unit 46. For this purpose an output interface 102 is provided in the sensor box 100 and a corresponding input interface 104 is provided in the control unit 101. The output interface 102 and the input interface 104 are formed, in this instance, as air interfaces which enable a wireless signal transmission from the sensor box 100 to the control unit 101 in the pump unit 46. This enables a very simple connection of the pump unit 46 and also of the sensors 94, 96 and 98, since these do not have to be connected directly to the pump unit 46. The sensors 94, 96 and 98 can thus be connected and wired independently of the circulating pump 46, and the circulating pump 46 can also be easily replaced, if necessary, without interfering with the wiring of the sensors. The control unit 101 in the circulating pump 46 preferably controls and regulates not only the circulating pump 46, but also the circulating pump 76, for which purpose the control unit 101 in the circulating pump 46 can communicate, preferably likewise wirelessly via radio, with the circulating pump 76 and the control device thereof. Both circulating pumps 46 and 76 can thus be connected very easily since only one electric connection is necessary for the mains power supply. The control communicates in a completely wireless manner.

Signal conditioning of the signals supplied by the sensors 94, 96 and 98 may also take place in the data detection module 100 or the sensor box 100 in order to provide the necessary data to the control device 101 in a predetermined format. The control unit 101 preferably reads from the output interface 102, via the input interface 104, only the data currently required for the control and therefore the data communication can be confined to a minimum.

The control unit 101 preferably also controls the circulation effected by the circulating pump 76 with use of the service water circulation module 74, in such a way that the circulating pump 76 is switched off for circulation when the temperature sensor 94 detects a temperature of the heating medium fed from the heat accumulator 4 which lies below a predetermined threshold value. The heat accumulator 4 can thus be prevented from cooling excessively owing to the service water circulation, and the circulation can instead be interrupted at times at which the heat supply to the heat accumulator 4 is too low, for example owing to a lack of solar irradiation on a solar module.

The control unit 101 controls the operation of the circulating pump 46 in such a way that the circulating pump 46 is first switched on when a heat demand for heating the service water is given, such that heating medium is fed from the heat accumulator 4 to the heat exchanger 6. If no service water circulation module 74 is provided, this heat demand for the service water is detected via the combined temperature/flow rate sensor 98. If this sensor detects a flow in the flow path through the connection part 60, i.e. a flow of service water, this means that a tap point for hot service water is open, such that cold service water flows in through the connection opening 38 and a heat demand for heating the service water is given. The control unit 101 can thus start up the circulating pump 46 in this case.

If the service water circulation module 74 is provided, the service water demand cannot be detected since the sensor 98, also owing to the circulation effected by the second circulating pump 76, detects a flow when no tap point for service water is open. In this case merely the temperature of the service water emergent from the heat exchanger 6 can be detected by the sensor 98 and, if this is below a predetermined threshold value, the circulating pump 46 can be switched on in order to compensate for the heat losses caused by circulation, in such a way that heating medium is fed to the heat exchanger 6 and the circulated service water is thus heated.

In this case the temperature sensor 96 is used in order to detect a service water demand owing to the opening of a tap point 7. As illustrated schematically in FIG. 11, this temperature sensor is not arranged precisely at the junction of the flow duct 32 in the base element 28 into which the portions of the flow duct from the connection openings 36 and 38 and 40 merge, but instead is offset from this junction towards the connection opening 38. This means, the temperature sensor 96 is located in the portion of the flow duct through which the cold service water is fed. If a tap point for heated service water is opened, this leads to a flow of cold service water in this line portion, such that a decrease in temperature is detected, as can be seen in the lower curve in FIG. 12, by the sensor 96 in the portion of the first flow duct 32, which runs to the connection opening 38. When such a decrease in temperature is detected, the control unit 101 switches on the circulating pump 46 for the supply of heating medium. A plurality of successive service water requests are illustrated in FIG. 12, which each lead again to a decrease in temperature and, once the request for heated service water is over, lead again to a rise in temperature since the water in the line portion in which the temperature sensor 96 is arranged is heated again.

In the second connector 30 the temperature sensor 96 is arranged slightly above the junction where the flow paths or portions of the flow duct 32 from the connection openings 36, 38 and 40 meet. It is thus ensured that the water in the line portion in which the sensor 96 is located is slowly heated again, when the tap point for service water is closed and there is thus no flow, by heat transfer by the service water circulated by the circulating pump 46 so as to flow from the connection opening 40 to the inlet 16.

As already described above, the heat exchanger 6 forms the bearing element of the service water heating unit 2, on which the connectors 26, 30, 48 and optionally 50 are fastened to the pumps 46 and optionally 76 and to the sensor box 100. The service water heating unit 2 thus forms an integrated module which can be incorporated as a prefabricated unit into a heating installation or into a heating system. The circulating pumps 46 and 76 are arranged relative to the heat exchanger 6 in such a way that their axes of rotation X extend parallel to the surfaces of the plates, in particular the outer plates 13. A holding device in the form of a clip 106 is mounted on the heat exchanger 6 in order to in turn fasten the heat exchanger 6 with the components mounted thereon to the heat accumulator 4 or to another element of a heating installation. The clip 106 forms a fastening device for fastening to the heat accumulator 4 and further forms handle elements 108 at which the entire service water heating unit 2 can be gripped, it thus being possible to handle the entire unit in a simple manner during assembly.

FIG. 14 shows a specific arrangement of service water heating units 2. In this arrangement four service water heating units 2 according to the description above are connected in parallel in a cascade-like manner in order to satisfy a greater service water demand. In the example illustrated, four service water heating units 2 are shown. However, it is to be understood that fewer or more service water heating units 2 can also be arranged accordingly depending on the maximum service water demand. In the example shown all service water heating units 2 are supplied with heating medium from a common heat accumulator 4. The service water heating units 2 are identical, except for one. The first service water heating unit 2, the one which is arranged beside the heat accumulator 4 in FIG. 14, is formed according to the design which is shown in FIGS. 1, 2, 4, 7, 8 and 11, i.e. this first service water heating unit 2 comprises a service water circulation module 74. The service water circulation module 74, which comprises the second circulating pump 46, is connected to the circulation line 90. This connects, at the tap point 7 located farthest away, to the line for heated service water DHW. Heated service water can thus be circulated through the entire line system, which supplies the tap points 7 with heated service water. The functioning of this service water heating unit 2 comprising a service water circulation module 74 basically corresponds to the description above. The three other service water heating units 2 are formed without a service water circulation module 74, i.e. as shown in FIG. 5.

Each of the service water heating units 2 according to FIG. 14 comprises a control unit 101 integrated into the circulating pump 46 and a separate sensor box 100. The individual control units 101 of the plurality of service water heating modules 2 communicate with one another via air interfaces 110 (see FIG. 13). In the first service water heating unit 2 the air interface 110 can also be used for communication with the second circulating pump 76 and optionally with the switching valve 66. However, it is also possible for the switching valve 66 to be controlled via the sensor box 100 and, for this purpose, is connected to the sensor box 100 via an electric connection line.

The control units 101 of all service water heating units 2 are formed identically and together control the cascade arrangement, as will now be described in greater detail with reference to FIG. 15.

In FIG. 15 the four service water heating units 2 are denoted as M1, M2, M3 and M4. In the small boxes arranged beneath, the numbers 1 to 4 denote the starting sequence of the service water heating units 2. The service water heating unit 2 which has position 1 in the starting sequence (in the first step M2) adopts a management function, i.e. is the managing service water heating unit 2, i.e. of which the control unit 101 also allows the further service water heating units 2 to be switched on and off.

If there is a service water request, i.e. one of the tap points 7 is opened, this is detected in the managing service water heating unit 2, as described above, by the combined temperature/flow rate sensor 98. The service water heating units 2 denoted by M2 to M4 are the service water heating units 2 shown in FIG. 14 without a service water circulation module 74. The service water heating unit 2 comprising the service water circulation module 74 is the module denoted in FIG. 15 by M1. This never adopts a managing function. If the managing module M2 now detects a service water request in step A, this service water heating unit 2 is started up first, i.e. the circulating pump 46 feeds heating medium to the associated heat exchanger 6. If the service water request is now switched off from steps B to C, this managing service water heating unit 2 is still heated in step C. If there is now a new service water request from steps C to D as a result of the opening of a tap point 7, this managing service water heating unit 2 (M2) is thus started up again. If the service water demand now increases, for example by the opening of a further tap point 7, a next service water heating unit 2 is switched on in step E in that the control unit 101 of the managing service water heating unit 2 (M2) of the service water heating unit 2 in the second position in the starting sequence (in this case M3) sends a signal for start-up. Its control unit 101 then accordingly starts up the circulating pump 46 of this further service water heating unit 2 (M3) in order to supply the heat exchanger 6 thereof with heating medium.

If the service water request is again stopped from step E to step F, the service water heating unit 2 is switched off and the control units 101 of the individual service water heating units 2 again determine the starting sequence among themselves. This occurs in that the service water heating unit 2 which was switched on last now adopts the first position in the starting sequence, and the service water heating unit 2 which was switched on first, i.e. the previously managing service water heating unit 2, returns to the last position (in this case M2). The managing function also changes accordingly to the service water heating unit 2 which is now in the first position in the starting sequence (M2). A uniform utilisation of the service water heating units 2 is thus ensured and the service water heating unit 2 which is started up first is simultaneously preferably a service water heating unit 2 which still contains residual heat. The service water heating unit 2 comprising the service water circulation module 74 always maintains the last position in the starting sequence, i.e. it is only switched on with maximum load and, for the rest, merely heats circulated service water. Should a service water heating unit 2 be faulty or fail, it is removed completely from the starting sequence, i.e. it is no longer started up at all. All this occurs by communication of the identical control units 101 with one another, and therefore a central control can be omitted.

A valve 112, which is not described above with reference to FIGS. 1 to 13, is additionally arranged in the inlet line for cold service water DCW of each service water heating unit 2 in order to switch off the service water heating units 2 when they are not heating service water. This valve 112 is controlled by the control unit via the sensor box 100. The valve 112 is preferably connected via an electrical connection line to the sensor box 100 and the control unit 101 sends a signal to the sensor box 100, via the input interface 104 and the output interface 102, to open and close the valve 112. If the valve 112 is closed, no service water flows through the respective heat exchanger 6, such that cold service water is prevented from flowing through the heat exchanger 6 of the unused service water heating units 2 into the outlet line for heated service water DHW.

The temperature control of the heated service water DHW in a service water heating unit 2 according to the above description will now be described with reference to FIG. 16. A regulator 114 is arranged in the control unit 101 and a setpoint temperature $T_{ref}$ for the heated service water DHW is predetermined for this regulator. For example, this setpoint temperature can be adjusted at the control unit 101 in the circulating pump 46. For this purpose control elements may be provided on the circulating pump 46. Alternatively, an adjustment may also be made via a wireless interface, for example infrared or radio, by means of remote operation or via system automation. The actual temperature $T_{DHW}$ of the heated service water DHW detected by the sensor 98 is subtracted from the setpoint value $T_{ref}$. The difference is fed to the regulator 114 as an error $\Delta T$. This outputs a setpoint speed $\omega_{ref}$ for the circulating pump 76, at which the circulating pump 46 is controlled, such that it feeds a volume flow $Q_{CH}$ of heating medium to the heat exchanger 6. The incoming cold service water DCW is then heated in this heat exchanger 6, such that it has the output temperature $T_{DHW}$ on the outlet side of the heat exchanger 6. This actual value $T_{DHW}$ is then, as described, detected by the sensor 98 and again fed to the regulator. This means, in accordance with the invention the speed of the circulating pump 46 and therefore the volume flow $Q_{CH}$ of the heating medium is controlled as a function of the output temperature of the hot service water DHW.

In this example, a disturbance variable feedforward is further provided in the regulator 114 in order to achieve a rapid response characteristic. For this purpose, the volume flow rate of the service water is also detected by the sensor 98 and this service water volume flow rate $Q_{DHW}$ is sent to the regulator 114 as a disturbance variable. Furthermore, the temperature $T_{CHin}$ of the heating medium fed to the heat exchanger 6 by the circulating pump 46 is detected by the temperature sensor 94 and is sent to the regulator 114 as a disturbance variable. Taking into account this disturbance variable, the setpoint speed $\omega_{ref}$ of the circulating pump 46 is accordingly adjusted, such that even the speed of the circulating pump 46 can be increased, for example with cooler heating medium and/or greater service water volume flow rate, in order to reach more quickly the required setpoint temperature $T_{ref}$ for the service water to be heated. A further disturbance variable or a further parameter which affects the service water temperature $T_{DHW}$ is the temperature $T_{DCW}$ of the incoming cold service water DCW. In the example shown, however, this is not sent to the regulator 114 as a disturbance variable, since the cold water temperature is generally basically constant. However, if the cold water temperature is subjected to considerable fluctuations, it would be conceivable to also send the temperature $T_{DCW}$ to the regulator 114 as a disturbance variable.

LIST OF REFERENCE NUMERALS

2—service water heating unit
4—heat accumulator
6—heat exchanger
7—tap point
8—housing
10—first flow path for the heating medium
12—second flow path for the service water
13—outer plates
14—inlet
16—outlet
18—inlet
20—outlet
22—temperature curve of the heating medium
24—temperature curve of the service water
26—first connector
28—base element
30—second connector
32, 34—flow ducts
36, 38, 40—connection openings or line connections
42—seals
44—feed line
46—first circulating pump
48—third connector
50—fourth connector
52—flow duct
54, 56, 58—connection openings or line connections
60—connection part
62—line connection
64—line
66—switching valve
68, 70—connection points
72—cold water line
74—service water circulation module
76—second circulating pump
78—connection part
80—pipe
81—seat
82—connection element
84—connecting piece
86, 88—connection openings
90—circulation line
92—sensor holder
94, 96—temperature sensors
97—junction
98—sensor
99—lines
100—sensor box
101—control unit or control and regulation electronics
102—output interface
104—input interface
106—clip
108—handle
110—radio interface
112—valve
DCW—cold service water
DHW—hot service water
CHO—hot heating medium, heating medium feed
CHR—cold heating medium, heating medium return
$T_{ref}$—setpoint temperature
$T_{DHW}$—temperature of the heated service water
$T_{DCW}$—temperature of the cold service water
$T_{CHin}$—temperature of the heating medium
$Q_{DHW}$—service water volume flow rate
$Q_{CH}$—heating medium volume flow rate
$\Delta T$—error
$\omega_{ref}$—setpoint speed

The invention claimed is:

1. A service water heating unit (2) provided for use in a heating installation, the service water heating unit comprising:

at least one heat exchanger (6) having a first flow path (10) in which a heating medium flows and a second flow path (12) in which service water to be heated flows;

a first circulation pump (46) which pumps the heating medium through the first flow path (10) of the at least one heat exchanger (6); and a second circulation pump (76) which pumps the heated service water through the second flow path (12);

the at least one heat exchanger forming a central component bearing part of the service water heating unit, with the first circulation pump being securely and mechanically fastened on the at least one heat exchanger and with the second circulation pump being removably and mechanically fastened on the at least one heat exchanger.

2. The service water heating unit according to claim 1, wherein the first circulation pump (46) is connected via a first connection point to the first flow path (10) of the at least one heat exchanger (6), and via a second connection point to a line connection (38) for the heating medium.

3. The service water heating unit according to claim 1, wherein the second circulation pump (76) is connected, via a first connection point, to a line connection (88) for a circulation line (90), and connected, via a second connection point, to either a line connection for a service water line or to the second flow path (12) of the at least one heat exchanger (6).

4. The service water heating unit according to claim 1, wherein the at least one heat exchanger (6) is a plate heat exchanger.

5. The service water heating unit according to claim 4, wherein an axis of rotation (X) of the first circulation pump (46) or the second circulation pump (76) extends parallel to a surface of a plate of the at least one heat exchanger (6).

6. The service water heating unit according to claim 1, wherein the first (46) and second (76) circulating pumps are arranged on two mutually opposed sides of the at least one heat exchanger (6).

7. The service water heating unit according to claim 6, wherein the mutually opposed sides of the at least one heat exchanger are formed by outer plates (13) of the at least one heat exchanger (6).

8. The service water heating unit according to claim 1, wherein a connector (30) is mounted on the at least one heat exchanger (6) at an inlet of the second flow path (12) and comprises a line connection (38) for a service water line and is connected to a connection point of the second circulation pump (76).

9. The service water heating unit according to claim 8, wherein the line connection (38) of the connector (30) is provided for connection to a cold water line.

10. The service water heating unit according to claim 8, wherein a temperature sensor or flow rate sensor (96) is arranged in a flow path in the connector (30).

11. The service water heating unit according to claim 10, wherein the connector (30) comprises a flow duct with a first duct portion to the line connection (38) and a second duct portion to the second circulation pump (76), which duct portions meet at a junction (97), the temperature or flow rate sensor (96) being arranged in the first duct portion at a distance from the junction (97).

12. The service water heating unit according to claim 1, wherein a fastening element (50) is mounted on the at least one heat exchanger (6), and at least one pipeline (80) connected to the second circulation pump (76) is fastened to the fastening element (50).

13. The service water heating unit according to claim 1, wherein a connector (30) for connection (40) of the second circulation pump (76) is provided and comprises a closable connection point for the circulation pump (76).

14. The service water heating unit according to claim 1, comprising a data detection module (100) comprising an output interface (102) designed for communication with an input interface (104) of a control unit (101) of at least one of the circulation pumps (46), and at least one sensor connected to the data detection module (100).

15. The service water heating unit according to claim 14, wherein the at least one sensor is a temperature sensor or a flow rate sensor.

16. The service water heating unit according to claim 1, wherein a holding device (106) is mounted on the at least one heat exchanger (6) to fasten the service water heating unit (2).

17. The service water heating unit according to claim 16, wherein the holding device is formed as a retaining clip.

18. The service water heating unit according to claim 1, wherein an intake connection of the first circulation pump is connected to a line connection for the heating medium, and a pressure connection of the first circulation pump is connected to the first flow path of the at least one heat exchanger.

19. The service water heating unit according to claim 1, wherein fluid connection points of the at least one heat exchanger are formed on side faces of the at least one heat exchanger.

20. The service water heating unit according to claim 19, wherein the fluid connection points are connected to the at least one heat exchanger via connectors fastened onto the side faces of the at least one heat exchanger.

* * * * *